US005476363A

United States Patent [19]

Freling et al.

[11] Patent Number: 5,476,363

[45] Date of Patent: Dec. 19, 1995

[54] METHOD AND APPARATUS FOR REDUCING STRESS ON THE TIPS OF TURBINE OR COMPRESSOR BLADES

[75] Inventors: Melvin Freling, West Hartford; Gary A. Gruver, South Windsor; Joseph J. Parkos, Jr., East Haddam; Douglas A. Welch, Portland, all of Conn.

[73] Assignee: Charles E. Sohl/Pratt & Whitney, East Hartford, Conn.

[21] Appl. No.: 138,521

[22] Filed: Oct. 15, 1993

[51] Int. Cl.[6] ..... F01D 11/08; F01D 5/14

[52] U.S. Cl. ..... 415/173.1; 415/173.4; 415/200; 416/223 A; 416/224; 416/228; 416/241 B; 29/889.7; 205/110; 205/118; 205/316; 72/53; 72/379.2; 427/448; 427/456

[58] Field of Search ..... 415/173.1, 173.4, 415/173.5, 174.4, 174.5, 200, 9, 217.1; 416/224 R, 224 A, 241 R, 241 B, 223 A, 228 R, 228 A; 29/889.7, 889.71, 889.72, 889.721, 889.722; 427/448, 456; 205/110, 122, 118, 316; 72/53, 379.2; 428/601, 614

[56] References Cited

U.S. PATENT DOCUMENTS

| | | | |
|---|---|---|---|
| 4,037,751 | 7/1977 | Miller et al. . | |
| 4,141,127 | 2/1979 | Cretella et al. | 416/241 R |
| 4,148,494 | 4/1979 | Zelahy et al. | 415/174.5 |
| 4,169,020 | 9/1979 | Stalker et al. . | |
| 4,232,995 | 11/1980 | Stalker et al. . | |
| 4,247,249 | 1/1981 | Siemers . | |
| 4,289,447 | 9/1981 | Sterman et al. . | |
| 4,390,320 | 6/1983 | Eiswerth . | |
| 4,514,469 | 4/1985 | Loersch et al. | 72/53 |
| 4,589,823 | 5/1986 | Koffel . | |
| 4,608,128 | 8/1986 | Farmer et al. | 205/110 |
| 4,715,178 | 12/1987 | Tsukuda et al. . | |
| 4,802,828 | 2/1989 | Rutz et al. | 415/173.4 |
| 4,808,055 | 2/1989 | Wertz et al. . | |
| 4,832,252 | 5/1989 | Fraser . | |
| 4,838,030 | 6/1989 | Cramer . | |
| 5,031,313 | 7/1991 | Blair et al. . | |
| 5,048,183 | 9/1991 | Cang et al. . | |
| 5,074,970 | 12/1991 | Routsis et al. . | |
| 5,264,011 | 11/1993 | Brown et al. | 416/241 B |

FOREIGN PATENT DOCUMENTS

| | | | |
|---|---|---|---|
| 0066602 | 5/1980 | Japan | 416/228 R |

*Primary Examiner*—Edward K. Look
*Assistant Examiner*—Christopher Verdier
*Attorney, Agent, or Firm*—Graybeal Jackson Haley & Johnson

[57] ABSTRACT

A method and apparatus for increasing blade fatigue strength in a turbine engine. The blades in the turbine engine are configured so as to reduce stress at the tip of the blades during operation of the turbine engine, thus increasing blade fatigue strength. This stress reduction helps to counteract the detrimental effect of abrasive tip coatings on blade fatigue strength. In one embodiment, the tip of the blade is chamfered in order to reduce the stress on the tip of the blade. An abrasive coating is then applied to the tip of the blade to assist the blade in seating into an abradable outer air seal. In another embodiment, an abrasive coating is applied to a center portion of the tip of the blade, with the periphery of the abrasive coating being set back from the opposing surfaces of the blade.

42 Claims, 3 Drawing Sheets

METHOD AND APPARATUS FOR REDUCING STRESS ON THE TIPS OF TURBINE OR COMPRESSOR BLADES

BACKGROUND OF THE INVENTION

The present invention relates to methods for reducing stress on the tips of blades in a gas turbine engine, and more specifically, to a method for reducing stress on blade tips intended to contact a circumferential seal.

Gas turbine engines include a series of compressor and turbine blades that rotate about a central axis of the engine. The efficiency of the compressor and of the engine depends in part on the volume of compressed air that leaks through the interface between the compressor blades and the surrounding circumferential shrouds or seals. Similarly, the efficiency of the turbine section is affected by leakage of the expanding products of combustion past the circumference of the turbine blades. Engine efficiency can be increased by decreasing the size of the gap between the tips of the compressor or turbine blades and the cooperating circumferential seal to reduce leakage past the blade, seal interface.

One prior art method used to reduce loss between the blade tips and the cooperating circumferential seal employs abradable seals. In this structural configuration, the circumferential seal that surrounds the blades is formed of a material that can readily be worn away or abraded by contact with the blade tips. In order to seat the blades in the seal, the blades are rotated so that the tips of the blades rub against or abrade the outer seal until a proper fit is achieved. This method of seating the seal produces a close tolerance fit that reduces air losses through the seal. The use of abradable outer seals has been successful in increasing engine efficiency.

In the past, the abradable outer seals were commonly formed of a material commonly referred to as "fiber" metal. Fiber metal is a very soft, easily abradable material that allowed the blade tips to cut into the seals without causing significant damage or wear to the blade tips.

In modern turbine engines, even closer tolerances between the blades and seals than have been achieved in the past are desirable to further increase engine efficiency. To achieve this, outer seals are being formed from harder, denser and more durable materials capable of producing closer tolerances and greater seal life. However, the use of such materials contributes to increased damage and wear of the blade tips during the seating process. Physical contact between the blade tips and the harder seal materials tends to abrade and damage the blade tips. This damage in turn contributes to increased blade wear and increased metal temperatures which can lead to failures due to crack initiation and propagation. Tip abrasion reduces overall blade life and affects the aerodynamic configuration of the blade, thus decreasing engine efficiency.

One method known to reduce blade tip wear during seal seating in the harder seal material is to apply an abrasive coating to the blade tips as shown in FIGS. 1–2. An abrasive coating 10 is applied to the tip 12 of a blade 14. The abrasive coating is a hard material that helps the blade to cut into the abradable seal without causing significant wear or damage to the abrasive coating 10 or blade tip 12. Often, the abrasive coating includes abrasive particles 16 that are trapped within some type of metal matrix. The abrasive particles may protrude from the tip coating in order to assist the blade tip in cutting into and seating in the abradable seal.

Two examples of methods to apply an abrasive tip coating are disclosed within U.S. Pat. Nos. 5,074,970 and 4,169,020, the specifications of which are incorporated herein by reference. Many different materials can be used as abrasive tip coatings, including nickel or aluminum oxide, cubic boron nitride, various abrasive carbides, oxides, silicides, nitrides, and other materials suspended in a matrix. Such coatings can be applied by electroplating, plasma spraying, or in accordance with other methods commonly known and practiced by those of ordinary skill in the art.

While it is true that abrasive tip coatings reduce blade tip wear and damage during the seating of the abradable seal, contact between the tip of the blade and the abradable seal add to the magnitude of the already high stress levels present at the tip of the blade during engine operation. As illustrated in FIG. 3, during engine operation, the tip of the blade tends to deform at a resonance frequency. A representative mode shape for a typical tip resonance bending mode is shown in phantom in FIG. 3. In the mode shown, the leading 17 and trailing 18 edges of the blade deform alternately inwardly and outwardly during resonance introducing bending stress through the thickness of the blade. As illustrated in the cross section of the blade shown in FIG. 4, the absolute magnitude of the stress 19 increases as one moves from the center of the blade toward either of the opposing surfaces. Contact between the tip of the blade and the circumferential seal further increases the magnitude of the stress at the blade tip and contributes to blade failure due to crack initiation and propagation.

Tip coatings further increase the magnitude of the stress at the blade tip because each of the abrasive particles 16 (FIG. 2) can act as an individual stress riser on the blade tip. These stress risers in turn increase the chance of blade failure due to crack initiation and propagation.

The use of abrasive tip coatings is especially detrimental to the fatigue life of blades formed from highly crack sensitive materials, such as titanium. Titanium is one of the preferred materials from which compressor blades are manufactured, due to its high strength, temperature tolerance, stiffness, and low density. Therefore, fatigue strength reductions caused by tip coatings are particularly important in the production of more efficient, long life turbine engines made with such materials.

As the understanding of the aerodynamic processes occurring within gas turbine engines improves, it will become even more important to reduce the detrimental effect of tip coatings on overall blade life. Blades are becoming increasingly thinner and more sharply contoured in order to increase aerodynamic efficiency. Thus, new blade configurations have less surface area on the blade tips on which to apply abrasive coatings. This decrease in surface area may require development of new abrasive coatings for seating the blades in the abradable seals.

SUMMARY OF THE INVENTION

The present invention helps to overcome the disadvantages of prior art blade designs by reducing the magnitude of the stress at the blade tip. This reduction in stress in turn helps to prevent crack initiation and growth, thus increasing blade fatigue strength. The present invention can be used to decrease stress at the tip of any blade. However, the present invention is particularly advantageous on blades having tip coatings. Furthermore, the present invention is applicable to blades formed of any materials, but is particularly advantageous for use on blades formed from crack sensitive materials, such as titanium alloys.

Stress at the tip of the blades is reduced by tailoring the configuration of the blade tip. The blade tip configuration is tailored to shift the maximum stress away from the blade tip, thus helping to increase high cycle fatigue strength.

In accordance with the present invention, a method for increasing blade fatigue strength in a turbine engine that includes blades, each of which has a base and a tip, provides for chamfering the blade tips over at least part of their width, to reduce stress concentrations at the blade tips during operation of the engine. In some embodiments, the tips are coated with an abrasive coating prior to chamfering, while in other embodiments, the blade tips are coated with an abrasive coating after chamfering. In still other embodiments, the blade tips are not coated at all. In some applications, the tip of the blade is either peened before or after chamfering to introduce compressive stresses in the blade tip which in turn increases blade fatigue strength.

In another embodiment of the present invention, the abrasive coating placed on the tip of the blade is applied only in a center portion of the blade tip. Thus, the coating does not extend to or touch the outer edges of the blade tip. By coating only the center portion of the tip of the blade, the stress concentrations at the blade tip due to the abrasive coating are reduced, thereby increasing blade fatigue strength. One preferred abrasive coating used is formed of cubic boron nitride particles embedded in a nickel alloy matrix. The abrasive coatings are applied by electroplating, plasma spraying, or by employing other application methods.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
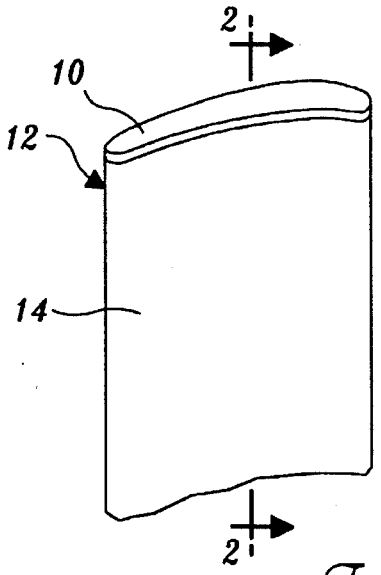
Fig. 1. PRIOR ART
FIG. 1 is an isometric view of a prior art blade that includes an abrasive tip coating.
Figure 2:
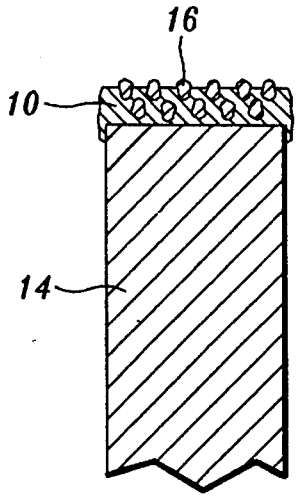
Fig. 2. PRIOR ART
FIG. 2 is an enlarged cross-sectional view of the blade of FIG. 1, taken along section line 2—2 in FIG. 1.

Referring initially to FIGS. 1–2, a prior art blade 14 that includes abrasive tip coating 10 on blade tip 12 and is configured to rub against a circumferential seal is illustrated. As discussed above, the prior art blade 14 is generally configured as an air foil for use in either the compressor or turbine section of a turbine engine (not shown). The abrasive tip coating 10 includes abrasive particles 16 that create stress concentrations at the interface between the abrasive tip coating and the blade tip 12. These stress concentrations in turn help to induce and propagate cracks at the blade tip 12 during engine operation.

Figure 6:
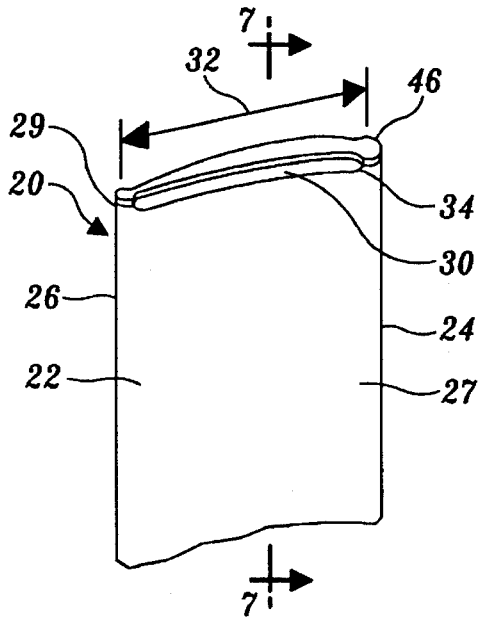
FIG. 6 is an isometric view of a blade in accordance with one preferred embodiment of the present invention.
Figure 7:
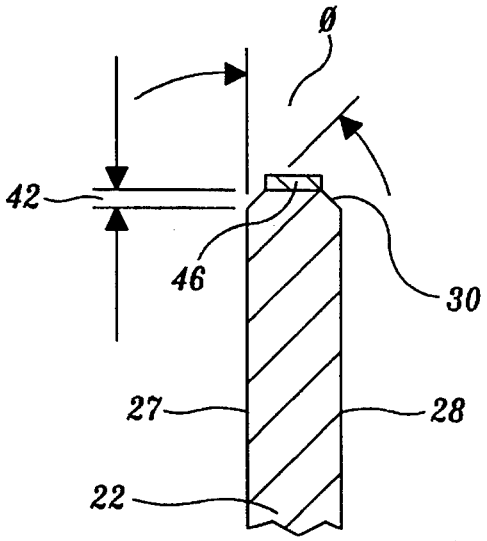
FIG. 7 is an enlarged cross-sectional view of the blade of FIG. 6, taken along section line 7—7 in FIG. 6.
Figure 3:
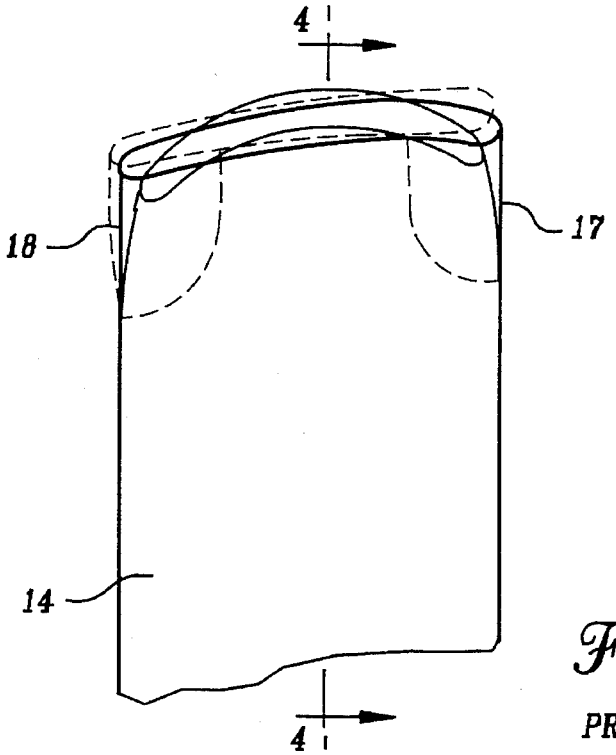
Fig. 3. PRIOR ART
FIG. 3 is an isometric view of the blade of FIG. 1 illustrating a representative bending mode shape.
Figure 4:
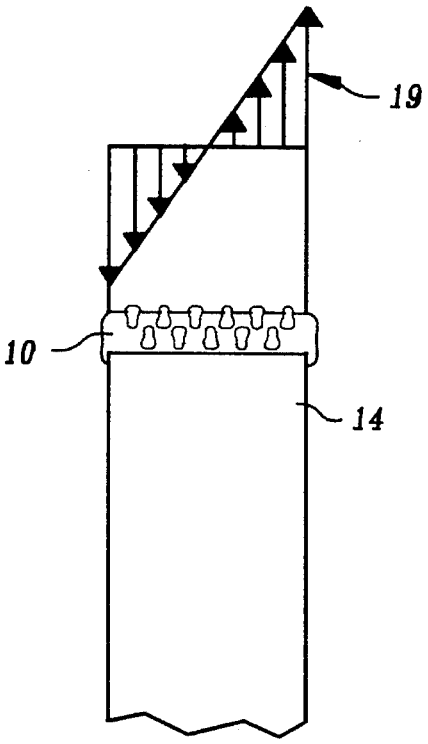
Fig. 4. PRIOR ART
FIG. 4 is an enlarged cross-sectional view of the blade of FIG. 3, taken along section line 4—4 in FIG. 3, illustrating the representative stress levels across the thickness of the blade.
Figure 5:
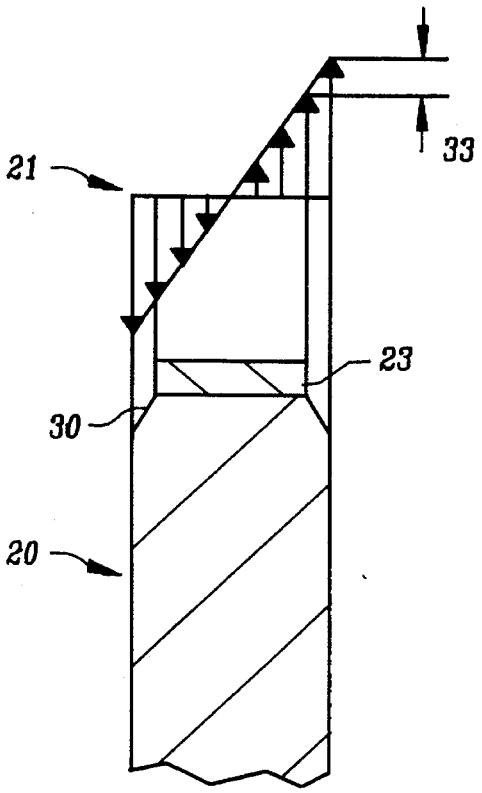
FIG. 5 is an enlarged cross-sectional view of a representative stress level across the thickness of a blade incorporating the present invention.

Now referring to FIGS. 5–7, a blade 20 including a first preferred embodiment of the present invention is illustrated. In accordance with the present invention, material is removed from the tip of the blade in order to reduce the stress at the tip of the blade. As illustrated in FIG. 5, by forming chamfers 30 on the tip of the blade or otherwise removing material from the tip of the blade, the stress distribution 21 at the tip of the blade caused by blade bending is altered. The maximum bending stress occurs at the outermost surface of the blade. Thus, by chamfering the edges of the blade at the tip 23, the stress at the tip of the blade is reduced by an amount 33. This reduction in stress at the blade tip reduces blade failure by reducing the chance of crack initiation and propagation at the blade tip.

The present invention is applicable to either compressor or turbine blades, both with and without tip coatings and is particularly suited to highly stressed titanium compressor blades due to the high susceptibility of titanium alloys to crack initiation and growth.

The preferred embodiment of blade 20 is represented in FIGS. 5–7 as having an air foil shape; however, the aerodynamic configuration of this embodiment of the blade is not meant to be limiting. In fact, the present invention is applicable to all different blade shapes and configurations. Blade 20 includes a body 22 having a leading edge 24, a trailing edge 26, a convex front and a concave back opposing surface 27 and 28, and a blade tip 29. The boundaries of the center portion of the blade tip are defined by the leading and trailing edges 24 and 26 and by opposing surfaces 27 and 28.

In accordance with the present invention, chamfers 30 extend along the opposing surfaces of the blade tip, at least partially between the leading and trailing edges 24 and 26. In the preferred embodiment shown, the chamfers 30 are located on both surfaces 27 and 28 and extend approximately an equal distance along the opposing surfaces of the blades. However, the configuration of the preferred embodiment shown is not meant to be limiting, and in alternative embodiments, the chamfers could extend different distances along the opposing surfaces of the blade tip, around the entire upper periphery of the blade tip, or along a single surface of the blade.

Figure 8:
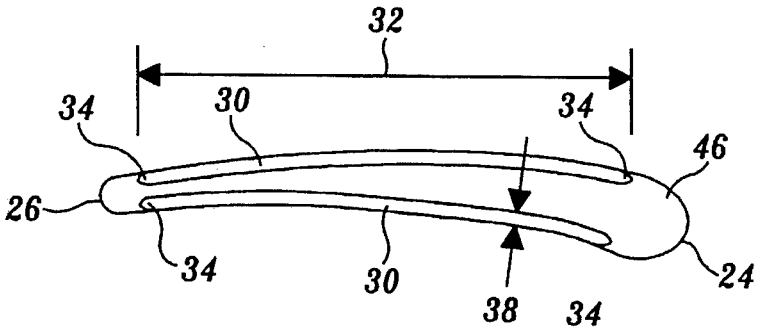
FIG. 8 is an elevational end view of the blade of FIG. 6.

As best seen in FIGS. 6 and 8, the chamfers 30 in the preferred embodiment begin behind the leading edge 24 of the blade and terminate ahead of the trailing edge 26 of the blade. In addition, as best seen in FIG. 7, the chamfers begin just below the tip of the blade and slant inwardly toward the center of the blade. In the preferred embodiment, the chamfers slope inwardly at an angle $\phi$ of approximately 45°. The angle of the chamfer thus shown and defined is not meant to be limiting; however, the preferred angle $\phi$ of the chamfer is believed to be within the approximate range of 30° to 50°. Further, the chamfer can comprise multiple angles or surfaces joined to form the chamfer. In the preferred embodiment, a distance 42 (measured along the length of the blade) over which the chamfer extends is approximately 8 to 15 mils. However, the dimensions of the chamfer illustrated are not limiting and other chamfer angles and lengths could be used in alternative embodiments.

The angle $\phi$ of the chamfer and the distance 42 over which the chamfer extends represent a tradeoff between the reduction in stress concentration desired at the blade tip and the amount of surface area of blade tip left after chamfering. The amount of surface area remaining on the blade tip after chamfering determines the amount of surface area on which a tip coating can be applied. This limit in turn determines the surface area of tip coating available to cut into the abradable outer seals during the seating procedures. If insufficient surface area remains after chamfering, it is possible that the tip coating might be worn away by contact with the abradable outer seal prior to completing the seating process. On the other hand, insufficient chamfering reduces the amount of stress relief provided, thus possibly reducing the advantages of the present invention, as discussed in more detail below.

Abrasive tip coatings can be formed of numerous different materials including aluminum oxide, cubic boron nitride, various abrasive carbides, oxides, silicides, nitrides, or other suitable materials capable of surviving the severe environments in which blades operate. These coatings can be applied through electroplating, plasma spraying, or by other suitable methods of application. In the preferred embodiment, a coating formed of cubic boron nitride particles embedded in a nickel alloy matrix is applied to the blade tips by electroplating.

Tailoring the angle $\phi$ of chamfer and distance 42 over which the chamfer extends controls the tradeoff between required blade tip area and required stress relief. If a lower angle of chamfer is used, a greater tip area remains, thus allowing a larger surface area on which to place an abrasive coating. Increasing the angle of chamfer or the distance of the chamfer allows the location of the stress concentration to be moved further downwardly, away from the tip of the blade. This effect in turn decreases the stress concentration at the interface between the tip coating 46 and the body 22 of the blade, thereby decreasing blade susceptibility to crack initiation and propagation. The dimensions of the chamfer will vary with differing blade designs; thus with each new design it will be necessary to optimize the dimensions of the chamfer.

As best seen in FIG. 8, the chamfer extends along the opposing surfaces of the blade tip over a distance 32. In the preferred embodiment, distance 32 is approximately 75–90% of the blade's overall width. However, the chamfer can extend over different percentages of overall blade width or around the entire periphery of the blade without affecting the efficiency of the present invention, depending on the blade configuration. As with the chamfer angle, the distance over which the chamfer extends represents a tradeoff between the amount of tip area available on which to apply a tip coating and the amount of stress reduction at the blade tip desired. The length of the chamfer must be sufficient to reduce the stress at the highest stressed areas of the blade tip. Generally, the middle portion of the blade is more highly stressed than the leading and trailing edges.

It is also desirable to form a radius of curvature 34 at the chamfer's leading and trailing edges. The radius of curvature helps to prevent any sharp blade contours that could increase stress concentrations at the blade tip. In the preferred embodiment, a radius of curvature of 0.047–0.078" is used; however, other radii could be used, depending on blade configuration and materials. The chamfers can be cut on the blade tip using a number of prior art grinding or milling methods.

In the preferred embodiment illustrated in FIGS. 6–8, the abrasive coating 46 is applied after the chamfering process such that the abrasive coating is not chamfered. Chamfering the blade prior to applying the abrasive coating is preferred because it simplifies handling and manufacturing of the blade. It is advantageous to peen the tip of the blade, including the chamfers, in order to induce compressive stresses in the chamfered region. These compressive stresses help to reduce crack initiation and propagation, thus increasing blade fatigue life. If peening is done after applying the abrasive coating, the abrasive coating could be damaged during the peening operation. Applying the abrasive coating after chamfering also helps to prevent damage to the abrasive coating during the chamfering process.

Figure 9:
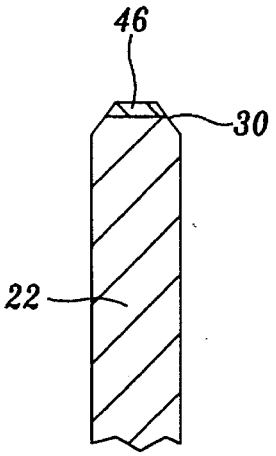
FIG. 9 is an enlarged cross-sectional view of an alternative embodiment of the blade of FIG. 6, taken along section line 7—7 in FIG. 6.

In the alternative embodiment shown in FIG. 9, the abrasive coating 46' has been applied to the blade tip prior to chamfering. Thus, the abrasive coating has also been chamfered. As with the preferred embodiment, it is then advantageous to peen the blade. Although, as discussed above, chamfering prior to coating is preferred due to manufacturing considerations, coating prior to chamfering reduces stress at the blade tip and is also included in the present invention.

For illustrative purposes only, the exemplary embodiments of the present invention use tip coating 46 formed of cubic boron nitride particles in a nickel alloy matrix. The tip coating has an average thickness of 3–15 mils. The tip of the blade is chamfered prior to tip coating at an angle of 45° and extends approximately 75–80% over the length of the blade. In addition, the length 42 over which the chamfer extends is approximately 8–15 mils.

Figure 10:
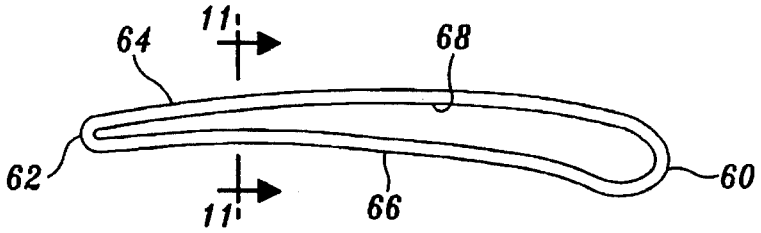
FIG. 10 is an elevational end view of a blade, including an alternate embodiment of the present invention.
Figure 11:
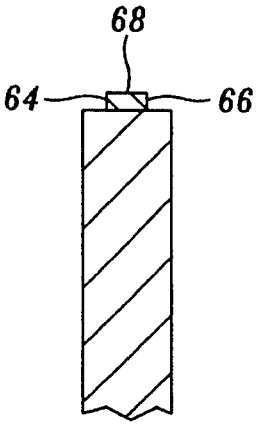
FIG. 11 is a cross-sectional view of the blade of FIG. 10, taken along section line 11—11 in FIG. 10.

An alternate embodiment of the present invention is illustrated in FIGS. 10 and 11. In this embodiment, chamfers are not used to reduce the stress concentrations at the blade tip. Instead, an abrasive coating 68 is applied only in the central portion of the tip of the blade. The abrasive coating begins slightly behind the leading edge 60 and terminates slightly ahead of the trailing edge 62. In addition, the edges of the abrasive coating do not extend all the way to the opposing surfaces 64 and 66 of the blade. Thus, the tip coating 68 is confined to the center portion of the blade tip and the peripheral edges of the tip coating are set back from the adjacent boundaries of the blade tip. As with chamfering, this alternative embodiment of the present invention decreases the stress concentrations at the intersection between the body of the blade and the tip coating. Because the tip coating is confined to the center portion of the blade tip, it helps to reduce the stress concentrations at the highest stress edges of the blade tip, thus helping to prolong blade fatigue life.

The present invention is also applicable to alternate blade configurations having no tip coatings. As explained with respect to the preferred embodiment, chamfering the tip of the blade or otherwise removing material from the tip of the blade allows the stress at the tip of the blade to be reduced. This in turn helps to reduce blade failures due to crack initiation or propagation at the blade tip regardless of coatings or no coatings.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of maintaining blade fatigue strength in a turbine engine wherein the blade contacts a circumferential seal, comprising the steps of:

(a) providing a blade having a base and a tip, the tip including leading and trailing edges, opposing surfaces, and a center portion defined by the leading and trailing edges and opposing surfaces; and (b) chamfering at least a portion of one or more of the opposing surfaces at an intersection between the opposing surfaces and the center portion of the tip of the blade where a high stress exists so as to reduce stress at the tip of the blade when the blade is used in a turbine engine, said at least one portion extending at most only partially around said tip.

2. The method of claim 1, further comprising the step of applying an abrasive coating on the center portion of the tip of the blade.

3. The method of claim 2, wherein the applying step further comprises applying the abrasive coating after the chamfering step.

4. The method of claim 2, wherein the applying step further comprises applying the abrasive coating by plasma spraying.

5. The method of claim 2, wherein the applying step further comprises applying the abrasive coating by electroplating.

6. The method of claim 2, wherein the step of applying comprises the step of applying cubic boron nitride particles in a nickel alloy matrix to the center portion of the tip of the blade.

7. The method of claim 1, further comprising the step of peening the tip of the blade after step (b).

8. The method of claim 7, further comprising the step of applying an abrasive coating on the center portion of the tip of the blade after the peening step.

9. The method of claim 1, wherein step (b) further comprises chamfering at least one of the opposing surfaces, beginning behind the leading edge and terminating ahead of the trailing edge.

10. A method of maintaining blade fatigue strength in a turbine engine wherein the blade contacts a circumferential seal, comprising the steps of:

(a) providing a blade having a blade tip including a leading edge, a trailing edge, opposing surfaces, and a center portion defined by the leading and trailing edges and opposing surfaces; and (b) applying an abrasive coating to the center portion of the blade tip so that a peripheral edge of the abrasive coating remains set back from the opposing surfaces of the blade tip and extends at least partially between the leading and trailing edges, said abrasion resistant coating extending further than the blade tip.

11. The method of claim 10 further comprising the step of peening the blade tip.

12. The method of claim 10, wherein the abrasive coating comprises cubic boron nitride particles embedded in a nickel alloy matrix, and wherein step (b) further comprises applying the cubic boron nitride coating to the center portion of the blade tip.

13. A method of maintaining blade fatigue strength in a turbine engine wherein the blade contacts a circumferential seal, comprising the steps of:

(a) providing a blade having a base and a tip, the tip including leading and trailing edges, opposing surfaces, and a center portion defined by the leading and trailing edges and opposing surfaces; and (b) chamfering at least a portion of both of the opposing surfaces at intersections between the opposing surfaces and the center portion of the tip of the blade where a high stress exists so as to reduce stress at the tip of the blade when the blade is used in a turbine engine.

14. The method of claim 13, further comprising the step of applying an abrasive coating on the center portion of the tip of the blade.

15. The method of claim 14, wherein the applying step further comprises applying the abrasive coating after the chamfering step.

16. The method of claim 14, wherein the applying step further comprises applying the abrasive coating by plasma spraying.

17. The method of claim 14, wherein the applying step further comprises applying the abrasive coating by electroplating.

18. The method of claim 14, wherein the step of applying comprises the step of applying cubic boron nitride particles in a nickel alloy matrix to the center portion of the tip of the blade.

19. The method of claim 13, further comprising the step of peening the tip of the blade after step (b).

20. The method of claim 19, further comprising the step of applying an abrasive coating on the center portion of the tip of the blade after the peening step.

21. The method of claim 13, wherein step (b) further comprises chamfering at least one of the opposing surfaces, beginning behind the leading edge and terminating ahead of the trailing edge.

22. A blade for use in a turbine engine wherein the blade contacts a circumferential seal, the blade comprising:

(a) a base and a tip, the tip including leading and trailing edges, opposing surfaces, and a center portion defined by the leading and trailing edges and opposing surfaces; and (b) a chamfer disposed on at least a portion of both of the opposing surfaces at intersections between the opposing surfaces and the center portion where a high stress exists.

23. The blade of claim 22, further comprising an abrasive coating disposed on the center portion of the blade and extending at least partially between the leading and trailing edges.

24. The blade of claim 23, wherein the abrasive coating comprises cubic boron nitride particles embedded in a nickel alloy matrix.

25. The blade of claim 23, wherein the abrasive coating is applied by electroplating.

26. The blade of claim 23, wherein the abrasive coating is applied by plasma spraying.

27. The blade of claim 22, wherein the chamfer begins behind the leading edge and terminates ahead of the trailing edge.

28. The blade of claim 22, wherein the blade tip has been peened.

29. A method of maintaining blade fatigue strength in a turbine engine wherein the blade contacts a circumferential seal, comprising the steps of:

(a) providing a blade having a base and a tip, the tip including leading and trailing edges, opposing surfaces, and a center portion defined by the leading and trailing edges and opposing surfaces; and (b) chamfering at least a portion of one or more of the opposing surfaces at an intersection beginning behind the leading edge and terminating ahead of the trailing edge between the opposing surfaces and the center portion of the tip of the blade where a high stress exists so as to reduce stress at the tip of the blade when the blade is used in a turbine engine.

30. The method of claim 29, further comprising the step of applying an abrasive coating on the center portion of the tip of the blade.

31. The method of claim 30, wherein the applying step further comprises applying the abrasive coating after the chamfering step.

32. The method of claim 30, wherein the applying step further comprises applying the abrasive coating by plasma spraying.

33. The method of claim 30, wherein the applying step further comprises applying the abrasive coating by electroplating.

34. The method of claim 30, wherein the step of applying comprises the step of applying cubic boron nitride particles in a nickel alloy matrix to the center portion of the tip of the blade.

35. The method of claim 29, further comprising the step of peening the tip of the blade after step (b).

36. The method of claim 35, further comprising the step of applying an abrasive coating on the center portion of the tip of the blade after the peening step.

37. A blade for use in a turbine engine wherein the blade contacts a circumferential seal, the blade comprising:

(a) a base and a tip, the tip including leading and trailing edges, opposing surfaces, and a center portion defined by the leading and trailing edges and opposing surfaces; and (b) a chamfer disposed at an intersection of at least one of the opposing surfaces and the center portion where a high stress exists and extending at least partially between the leading and trailing edges, wherein the chamfer begins behind the leading edge and terminates ahead of the trailing edge.

38. The blade of claim 37, further comprising an abrasive coating disposed on the center portion of the blade and extending at least partially between the leading and trailing edges.

39. The blade of claim 38, wherein the abrasive coating comprises cubic boron nitride particles embedded in a nickel alloy matrix.

40. The blade of claim 38, wherein the abrasive coating is applied by electroplating.

41. The blade of claim 38, wherein the abrasive coating is applied by plasma spraying.

42. The blade of claim 37, wherein the blade tip has been peened.

* * * * *